US010264377B2

(12) United States Patent
Ping et al.

(10) Patent No.: US 10,264,377 B2
(45) Date of Patent: Apr. 16, 2019

(54) METHOD AND SYSTEM FOR SIMULTANEOUSLY VERIFYING AMPLITUDE AND TEMPERATURE PARAMETERS OF ELECTRICAL-ACOUSTIC CONVERSION DEVICE

(71) Applicant: GOERTEK.INC, Weifang, Shandong (CN)

(72) Inventors: Kang Ping, Weifang (CN); Xinfeng Yang, Weifang (CN); Jie Wei, Weifang (CN)

(73) Assignee: GOERTEK.INC, Weifang, Shandong (CN)

( * ) Notice: Subject to any disclaimer, the term of this patent is extended or adjusted under 35 U.S.C. 154(b) by 0 days.

(21) Appl. No.: 15/553,414

(22) PCT Filed: Dec. 17, 2015

(86) PCT No.: PCT/CN2015/097755
§ 371 (c)(1),
(2) Date: Aug. 24, 2017

(87) PCT Pub. No.: WO2016/192379
PCT Pub. Date: Dec. 8, 2016

(65) Prior Publication Data

US 2018/0048973 A1 Feb. 15, 2018

(30) Foreign Application Priority Data

Jun. 1, 2015 (CN) ..... 2015 1 0293055

(51) Int. Cl.
*H04R 23/00* (2006.01)
*H04R 29/00* (2006.01)
*H04R 3/00* (2006.01)

(52) U.S. Cl.
CPC ..... *H04R 29/00* (2013.01); *H04R 23/002* (2013.01); *H04R 29/003* (2013.01); *H04R 3/007* (2013.01)

(58) Field of Classification Search
CPC ..... H04R 29/00; H04R 23/00; H04R 23/002; H04R 3/007
See application file for complete search history.

(56) References Cited

U.S. PATENT DOCUMENTS

2004/0178852 A1* 9/2004 Neunaber ..... H03F 1/52 330/284
2012/0020488 A1* 1/2012 Huijser ..... H04R 3/007 381/59

* cited by examiner

*Primary Examiner* — Sunita Joshi
(74) *Attorney, Agent, or Firm* — Ladas & Parry LLP

(57) ABSTRACT

Disclosed are a method, system and controller for simultaneously verifying amplitude and temperature parameters of an electrical-acoustic conversion device, including: inputting a sweep signal to the electrical-acoustic conversion device; testing the amplitude of the electrical-acoustic conversion device while adjusting the gain of the whole frequency band of the sweep signal until the maximum value of the tested amplitude is a maximum amplitude parameter Xmax, and testing the temperature of a voice coil at this moment; and if the tested temperature of the voice coil at this moment is higher or lower than Tmax, gradually reducing/increasing the gain of the sweep signal in the frequency band above a gain improvement frequency point until the tested temperature of the voice coil is Tmax, and then maintaining the gain of the sweep signal for a predetermined period of time and then testing the performance of the electrical-acoustic conversion device.

7 Claims, 3 Drawing Sheets

METHOD AND SYSTEM FOR SIMULTANEOUSLY VERIFYING AMPLITUDE AND TEMPERATURE PARAMETERS OF ELECTRICAL-ACOUSTIC CONVERSION DEVICE

CROSS REFERENCE TO RELATED APPLICATION

This application is a national stage application, filed under 35 U.S.C. § 371, of international Application No. PCT/CN2015/097755, filed on Dec. 17, 2015, which claims a priority to Chinese Application No. 201510293055.0 filed on Jan. 6, 2015, the contents of which are hereby incorporated by reference in their entirety.

FIELD OF THE INVENTION

The present invention relates to a method and system for simultaneously verifying amplitude and temperature parameters of an electrical-acoustic conversion device simultaneously and a controller for verifying amplitude and temperature parameters of an electrical-acoustic conversion device.

BACKGROUND OF THE INVENTION

Intelligent power amplifier systems are rapidly promoted in the field of mobile phones due to their dual functions of improving the sound quality of the electrical-acoustic conversion device and protecting the electrical-acoustic conversion device. Intelligent power amplifiers can monitor the amplitude and temperature situations of the voice coil of the electrical-acoustic conversion device in real time and give feedback, realizing the purpose of protecting the electrical-acoustic conversion device. This requires the manufacturers of electrical-acoustic conversion devices to provide accurate maximum amplitude parameter and highest temperature parameter of the voice coil, which parameters break the existing parameter definition method and reliability verification method. In order to cooperate with the intelligent power amplifiers to protect and improve the performance of the electrical-acoustic conversion devices, it requires to verify the rationality of the maximum amplitude parameter Xmax and the highest temperature parameter Tmax of the voice coil.

The traditional verification method is to verify the maximum amplitude parameter Xmax and the highest temperature parameter Tmax of the voice coil respectively.

FIG. 1 shows a solution of verifying the maximum amplitude parameter Xmax. A sweep signal generator 1 generates a traditional sweep signal, a power amplifier 2 amplifies the same and inputs the same into an electrical-acoustic conversion device, an amplitude range finder 3 measures the maximum amplitude to detect whether the maximum amplitude satisfies the maximum amplitude parameter Xmax to be verified. If not, then the gain of the power amplifier unit is increased or reduced until the actual tested maximum amplitude satisfies Xmax. Performance experiment is performed on the electrical-acoustic conversion device after operating for a predetermined period of time with this sweep signal and gain.

FIG. 2 shows a solution of verifying the highest voice coil parameter Xmax. The sweep signal generator 1 generates a traditional sweep signal, the power amplifier 2 amplifies the same and inputs the same into an electrical-acoustic conversion device, a temperature detector 4 tests the temperature of the voice coil to detect whether the temperature of the voice coil satisfies the highest voice coil parameter Tmax to be verified. If not, then the gain of the power amplifier unit is increased or reduced until the actually highest voice coil parameter satisfies Tmax. Performance experiment is performed on the electrical-acoustic conversion device after operating for a predetermined period of time with this sweep signal and gain.

However, the inventors have found that the above method has the following limitations.

(1) During the normal operation of an electrical-acoustic conversion device, both the amplitude and the temperature of the voice coil affect the operation state of the electrical-acoustic conversion device. In the state where the amplitude is maximum and the temperature of the voice coil is highest, the electrical-acoustic conversion device can still operate normally, and such Xmax and Tmax are effective and rational. However, in the traditional verification method, the verification of the amplitude and the verification of the highest temperature of the voice coil are separated and the actual situation cannot be simulated.

(2) In the traditional method, when verifying the amplitude, in order to make the amplitude reach the maximum amplitude parameter Xmax to be verified, the gain of the power amplifier will be increased or reduced, which will inevitably make the temperature of the voice coil increase or reduce, and even the temperature of the voice coil may exceed the tolerable temperature of the voice coil and cause burning. In such a case, it is difficult to determine whether the failure is caused by irrational Xmax or by the affection of the temperature of the voice coil. At the same time, when verifying the temperature of the voice coil, in order to make the temperature of the voice coil reach the highest temperature Tmax of the voice coil to be verified, the gain of the power amplifier will be increased or reduced, which will inevitably make the amplitude of the entire frequency band increase or reduce, and even the amplitude may exceed the tolerable range of the voice coil and cause the voice coil short-circuited. In such a case, it is difficult to determine whether the failure is caused by the irrational highest temperature Xmax of the voice coil or caused by the affection of the amplitude.

SUMMARY OF THE INVENTION

An object of the present invention is to provide a new technical solution capable of simultaneously verifying amplitude and temperature parameters of an electrical-acoustic conversion device.

According to a first aspect of the present invention, a method for simultaneously verifying amplitude and temperature parameters of an electrical-acoustic conversion device is provided, comprising the following steps: S1, inputting a sweep signal to the electrical-acoustic conversion device; S2, testing the amplitude of the electrical-acoustic conversion device while adjusting the gain of the whole frequency band of the sweep signal until the maximum value of the tested amplitude is a maximum amplitude parameter Xmax, and testing the temperature of the voice coil at this moment; and S3, if the tested temperature of the voice coil at this moment is the highest temperature parameter Tmax of the voice coil, maintaining the gain of the sweep signal for a predetermined period of time and then testing the performance of the electrical-acoustic conversion device; if the tested temperature of the voice coil at this moment is higher or lower than Tmax, gradually reducing/increasing the gain of the sweep signal in the frequency band above a gain improvement frequency point until the tested temperature of the voice coil is Tmax, and then maintaining the gain of the sweep signal for a predetermined period of time and then testing the performance of the electrical-acoustic conversion device, wherein the gain improvement frequency point is greater than the resonance frequency F0 of the electrical-acoustic conversion device.

Preferably, the sweep signal is a sine sweep signal with a frequency range of 100 Hz-20 kHz.

Preferably, the gain improvement frequency point is greater than the resonance frequency F0 of the electrical-acoustic conversion device plus 100 Hz.

Preferably, the gain improvement frequency point is 4 kHz.

Preferably, the method further comprises a step S4 of: if the tested performance of the electrical-acoustic conversion device is qualified, increasing Xmax by 0.01 mm and at the same time increasing Tmax by 5□, and then retesting according to steps S1-S3.

Preferably, the method further comprises a step S5 of: if the tested performance of the electrical-acoustic conversion device is unqualified, determining that the maximum amplitude parameter Xmax and the highest temperature parameter Tmax of the voice coil are irrational.

According to a second aspect of the present invention, a system for simultaneously verifying amplitude and temperature parameters of an electrical-acoustic conversion device is provided, comprising: a controller, a sweep signal generator, a power amplification unit, an amplitude range finder and a temperature detector; wherein the controller includes a parameter input module and a gain adjustment module which is connected to the sweep signal generator to control the gain of a sweep signal emitted by the sweep signal generator, and wherein the sweep signal is input to the electrical-acoustic conversion device after being amplified by the power amplification unit; the amplitude range finder is configured to test the amplitude of the electrical-acoustic conversion device and send the tested amplitude to the gain adjustment module, and the temperature detector is configured to test the temperature of the voice coil of the electrical-acoustic conversion device and send the tested temperature of the voice coil to the gain adjustment module; the parameter input module is configured to input a maximum amplitude parameter Xmax and a highest temperature parameter Tmax of the voice coil of the electrical-acoustic conversion device and send the maximum amplitude parameter Xmax and the highest temperature parameter Tmax of the voice coil to the gain adjustment module; and the gain adjustment module is configured for: adjusting the gain of the whole frequency band of the sweep signal until the tested amplitude maximum value is Xmax, if the tested temperature of the voice coil at this moment is Tmax, maintaining the gain of the sweep signal for a predetermined period of time and then testing the performance of the electrical-acoustic conversion device; if the tested temperature of the voice coil at this moment is higher or lower than Tmax, gradually reducing/increasing the gain of the sweep signal in the frequency band above a gain improvement frequency point until the tested temperature of the voice coil is Tmax, and then maintaining the gain of the sweep signal for a predetermined period of time and then testing the performance of the electrical-acoustic conversion device, wherein the gain improvement frequency point is greater than the resonance frequency F0 of the electrical-acoustic conversion device.

Preferably, the sweep signal emitted by the sweep signal generator is a sine sweep signal with a frequency range of 100 Hz-20 kHz.

Preferably, the gain improvement frequency point is greater than the resonance frequency F0 of the electrical-acoustic conversion device plus 100 Hz.

Preferably, the gain improvement frequency point is 4 kHz.

Preferably, the parameter input module is further configured to: if the tested performance of the electrical-acoustic conversion device is unqualified, increase Xmax by 0.01 mm and at the same time increase Xmax by 5° C., and send the increased maximum amplitude parameter Xmax and the increased highest temperature parameter Tmax of the voice coil to the gain adjustment module.

According to a third aspect of the present invention, a controller for simultaneously verifying amplitude and temperature parameters of an electrical-acoustic conversion device, comprising a parameter input module and a gain adjustment module, wherein the parameter input module is configured to input a maximum amplitude parameter Xmax and a highest temperature parameter Tmax of the voice coil of the electrical-acoustic conversion device and send the maximum amplitude parameter Xmax and the highest temperature parameter Tmax of the voice coil to the gain adjustment module; and the gain adjustment module is configured to receive the tested amplitude and temperature of the voice coil of the electrical-acoustic conversion device and adjust the gain of the sweep signal input to the electrical-acoustic conversion device such that the maximum value of the tested amplitude of the electrical-acoustic conversion device is Xmax and the temperature of the voice coil is Tmax.

Preferably, the gain adjustment module adjusting the gain of the sweep signal input to the electrical-acoustic conversion device includes: adjusting the gain of the whole frequency band of the sweep signal until the tested amplitude maximum value is Xmax, if the tested temperature of the voice coil at this moment is higher or lower than Tmax, gradually reducing/increasing the gain of the sweep signal in the frequency band above a gain improvement frequency point until the tested temperature of the voice coil is Tmax, wherein the gain improvement frequency point is greater than the resonance frequency F0 of the electrical-acoustic conversion device.

The inventors of the present invention have found that respectively performing amplitude verification and temperature verification on an electrical-acoustic conversion device in the prior art has great limitations and caused inaccuracies. Thus the technical task to be realized by the present invention or the technical problem to be solved by the present invention has never been contemplated or anticipated by those skilled in the art. Therefore, the present invention relates to a new technical solution.

The other features and advantages of the present invention will become clear according to the detailed description of exemplary embodiments of the present invention with reference to the accompanying drawings.

BRIEF DESCRIPTION OF THE DRAWINGS

The figures incorporated in the description and forming a part of the description illustrate the embodiments of the present invention and are used to explain the principle of the present invention along therewith.

DETAILED DESCRIPTION OF THE EMBODIMENTS

Various exemplary embodiments of the present invention will be described in detail with reference to the accompanying drawings. It should be noted that unless stated specifically otherwise, the relative arrangement of the components and steps illustrated in these embodiments, the numeral expressions and the values do not limit the scope of the present invention.

The description of at least one exemplary embodiment of the present invention is actually merely illustrative rather than limiting the present invention and the application or use thereof.

Technologies, methods and devices known to those skilled in the art may not be described in detail but these technologies, method and device shall be regarded as a part of the description when appropriate.

Any particular value in all examples illustrated and described here shall be construed as merely illustrative rather than limiting. Thus, other examples of the exemplary embodiments may have different values.

It should be noted that similar signs and letters represent similar items in the following figures, and thus, once a certain item is defined in a figure, there is no need to further describe the same in the following figures.

Figure 1:
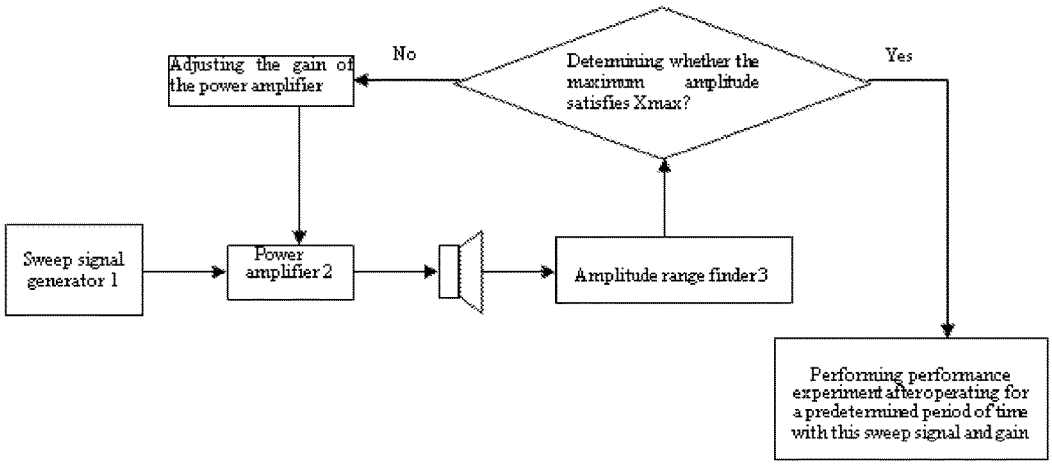
FIG. 1 is a schematic view of a method for verifying a maximum amplitude parameter Xmax in the prior art.
Figure 2:
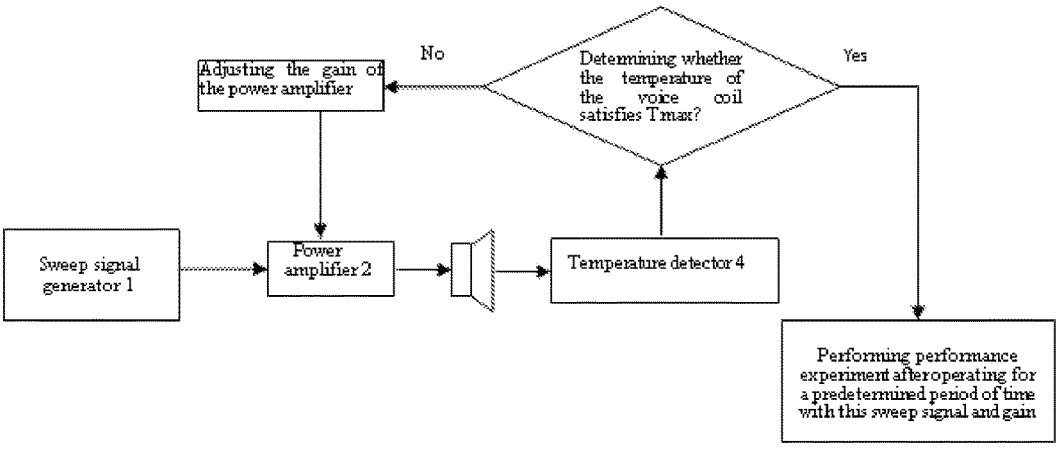
FIG. 2 is a schematic view of a method for verifying a highest temperature parameter Tmax of the voice coil in the prior art.
Figure 3:
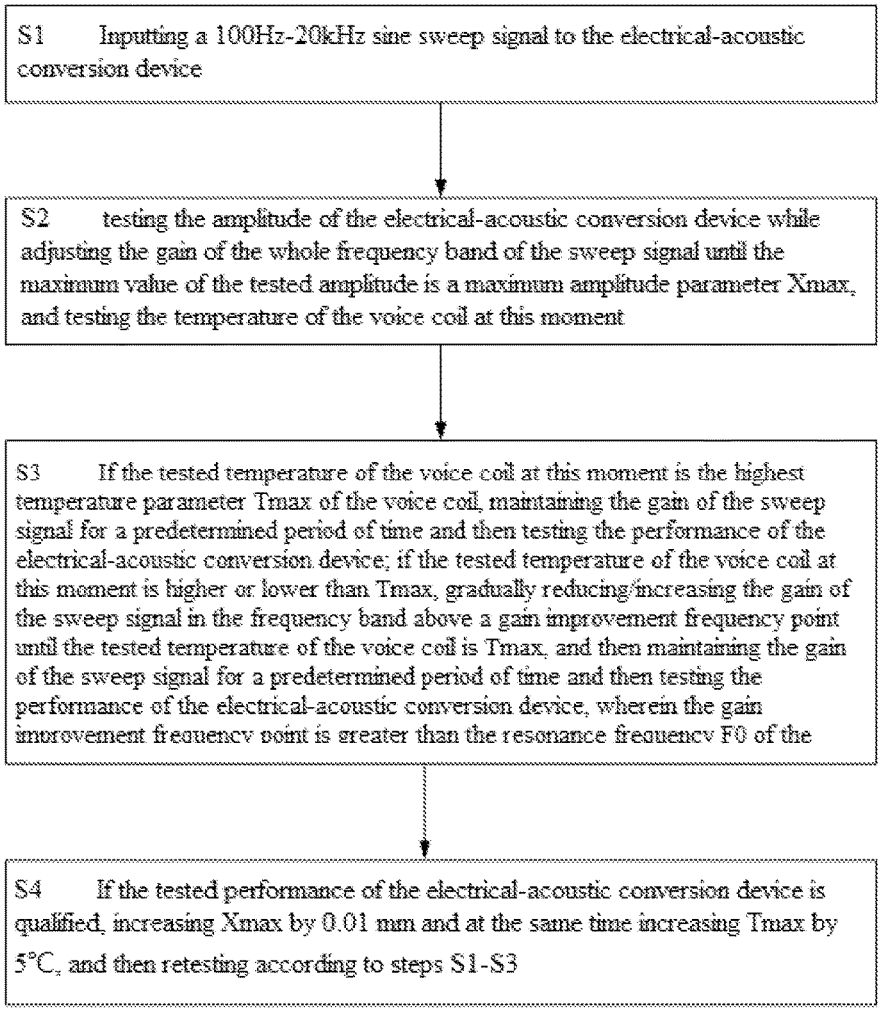
FIG. 3 is a flowchart of a method for simultaneously verifying amplitude and temperature parameters in the present invention.

Referring to FIG. 3, the present invention provides a method for simultaneously verifying amplitude and temperature parameters of an electrical-acoustic conversion device. The method includes the following steps.

S1, inputting a sweep signal to the electrical-acoustic conversion device.

S2, testing the amplitude of the electrical-acoustic conversion device while adjusting the gain of the whole frequency band of the sweep signal until the maximum value of the tested amplitude is a maximum amplitude parameter Xmax, and the temperature of the voice coil at this moment is tested.

S3, if the tested temperature of the voice coil at this moment is the highest temperature parameter Tmax of the voice coil, maintaining the gain of the sweep signal unchanged for a predetermined period of time and then testing the performance of the electrical-acoustic conversion device; if the tested temperature of the voice coil at this moment is higher or lower than Tmax, gradually reducing/increasing the gain of the sweep signal in the frequency band above a gain improvement frequency point until the tested temperature of the voice coil is Tmax, and then maintaining the gain of the sweep signal unchanged for a predetermined period of time and then testing the performance of the electrical-acoustic conversion device, wherein the gain improvement frequency point is greater than the resonance frequency F0 of the electrical-acoustic conversion device.

S4, if the tested performance of the electrical-acoustic conversion device is qualified, increasing Xmax by 0.01 mm and at the same time increasing Tmax by 5□, and then retesting according to steps S1-S3.

S5, if the tested performance of the electrical-acoustic conversion device is unqualified, determining that the maximum amplitude parameter Xmax and the highest temperature parameter Tmax of the voice coil are irrational.

The electrical-acoustic conversion device in the present invention may be for example a speaker or receiver. The sweep signal may be a sine sweep signal with a frequency range of 100 Hz-20 kHz.

The maximum amplitude parameter Xmax refers to the maximum amplitude allowed by the electrical-acoustic conversion device in normal operation. The highest temperature Tmax of the voice coil refers to the highest temperature of the voice coil allowed by the electrical-acoustic conversion device in normal operation.

In the present invention, the gain improvement frequency point is set to be greater than the resonance frequency F0 of the electrical-acoustic conversion device. After the maximum value of the amplitude of the electrical-acoustic conversion device reaches Xmax, adjusting the gain of the frequency band above the gain improvement frequency point of the sweep signal will not affect the maximum value of the amplitude of the electrical-acoustic conversion device, and the maximum value of the amplitude of the electrical-acoustic conversion device is still Xmax. The gain improvement frequency point may a certain amount greater than the resonance frequency F0. Preferably, the gain improvement frequency point is greater than the resonance frequency F0 of the electrical-acoustic conversion device plus 100 Hz, or the gain improvement frequency point is typically selected to be 4 kHz, which can satisfy the test requirements in the present invention on various electrical-acoustic conversion devices in the market.

Testing the performance of an electrical-acoustic conversion device may include for example testing the frequency response, sensitivity, directivity, noise, output frequency and so on of the electrical-acoustic conversion device. In a case that after a predetermined period of time, such as after 96 hours, the performance of the electrical-acoustic conversion device has no reduction compared to that at the beginning and the appearance thereof is still good, it indicates that the performance of the electrical-acoustic conversion device is qualified. An object of the present invention is to verify the maximum amplitude parameter Xmax and the highest temperature parameter Tmax of the voice coil of an electrical-acoustic conversion device simultaneously. Thus, in the present invention, it merely requires to make the maximum value of the amplitude of the electrical-acoustic conversion device be the maximum amplitude parameter Xmax and the temperature of the voice coil be the highest temperature Tmax of the voice coil. Then, the time amount of the predetermined period of time and specific items of the performance test may be set according to different performance requirements of the electrical-acoustic conversion device, which will fall within the protection scope of the present invention.

After performance test is completed with steps S1-S3, if the tested performance of the electrical-acoustic conversion device is unqualified, it can be determined that the maximum amplitude parameter Xmax and the highest temperature parameter Tmax of the voice coil are irrational. Otherwise, they can be primarily determined as rational.

After the performance test of steps S1 to S3, if the tested performance of the electrical-acoustic conversion device is qualified, that is, the electrical-acoustic conversion device operates normally at Xmax and Tmax, Xmax and Tmax still cannot be determined as the maximum values allowed in actual applications of the electrical-acoustic conversion device. The maximum amplitude and the highest temperature of the voice coil in the actual application of the electrical-acoustic conversion device may be obtained according to the following method: increasing Xmax by 0.01 mm and at the same time increasing Tmax by 5□, and then retesting according to steps S1 to S3; iteratively performing steps S1 to S4 to gradually approach the amplitude and the highest temperature of the voice coil in the actual application of the electrical-acoustic conversion device.

Figure 4:
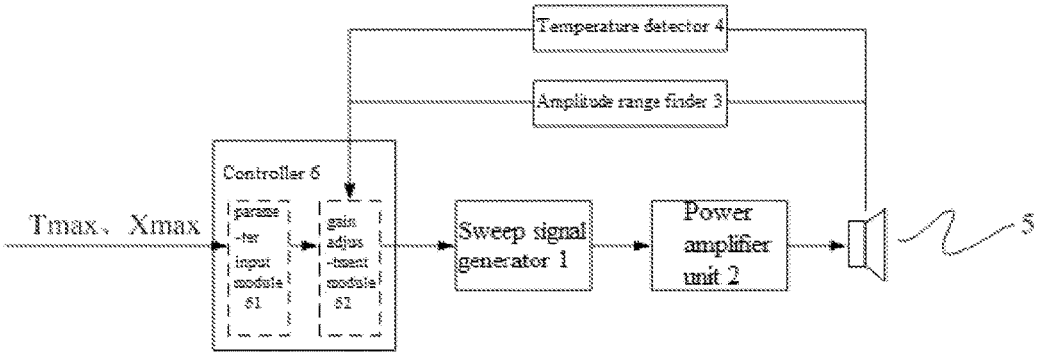
FIG. 4 is a block diagram of the circuit of a system for simultaneously verifying amplitude and temperature parameters in the present invention.

As shown in FIG. 4, the present invention also provides a system for simultaneously verifying amplitude and temperature parameters of an electrical-acoustic conversion device, comprising: a controller 6, a sweep signal generator 1, a power amplification unit 2, an amplitude range finder 3 and a temperature detector 4. The amplitude range finder 3 may be for example a laser range finder.

The controller 6 includes a parameter input module 61 and a gain adjustment module 62. The gain adjustment module 62 is connected to the sweep signal generator 1 to control the gain of a sweep signal emitted by the sweep signal generator 1. The sweep signal is input to an electrical-acoustic conversion device 5 after being amplified by the power amplification unit 2.

The amplitude range finder 3 is configured to test the amplitude of the electrical-acoustic conversion device 5 and send the tested amplitude to the gain adjustment module 62. The temperature detector 4 is configured to test the temperature of the voice coil of the electrical-acoustic conversion device 5 and send the tested temperature of the voice coil to the gain adjustment module 62.

The parameter input module 61 is configured to input a maximum amplitude parameter Xmax and a highest temperature parameter Tmax of the voice coil of the electrical-acoustic conversion device 5 and send the maximum amplitude parameter Xmax and the highest temperature parameter Tmax of the voice coil to the gain adjustment module 62.

The gain adjustment module 62 is configured to adjust the gain of the whole frequency band of the sweep signal until the maximum value of the tested amplitude is Xmax, that is, the actual tested amplitude of the electrical-acoustic conversion device at the resonance frequency F0 is Xmax. If the tested temperature of the voice coil at this moment is Tmax, the gain of the sweep signal is maintained unchanged for a predetermined period of time to test the performance of the electrical-acoustic conversion device 5 after a predetermined period of time. If the tested temperature of the voice coil at this moment is higher or lower than Tmax, the gain of the sweep signal in the frequency band above a gain improvement frequency point is gradually reduced until the tested temperature of the voice coil is reduced to Tmax, and then the gain of the sweep signal is maintained unchanged for a predetermined period of time to test the performance of the electrical-acoustic conversion device 5. 1f the tested temperature of the voice coil is lower than Tmax, the gain of the sweep signal in the frequency band above a gain improvement frequency point is gradually increased until the tested temperature of the voice coil reaches Tmax, and then the gain of the sweep signal is maintained unchanged for a predetermined period of time to test the performance of the electrical-acoustic conversion device 5. The gain improvement frequency point is greater than the resonance frequency F0 of the electrical-acoustic conversion device.

The system may also include a determination unit configured to, if the tested performance of the electrical-acoustic conversion device 5 is unqualified, determine that the maximum amplitude parameter Xmax and the highest temperature parameter Tmax of the voice coil are irrational.

The parameter input module 61 is further configured to: if the tested performance of the electrical-acoustic conversion device 5 is unqualified increase Xmax by 0.01 mm and at the same time increase Xmax by 5□, and send the increased maximum amplitude parameter Xmax and the increased highest temperature parameter Tmax of the voice coil to the gain adjustment module 62. Then, the gain adjustment module 62 re-adjusts the gain of the sweep signal according to the above method to retest the performance of the electrical-acoustic conversion device 5 with the increased Xmax and Tmax.

Figure 5:
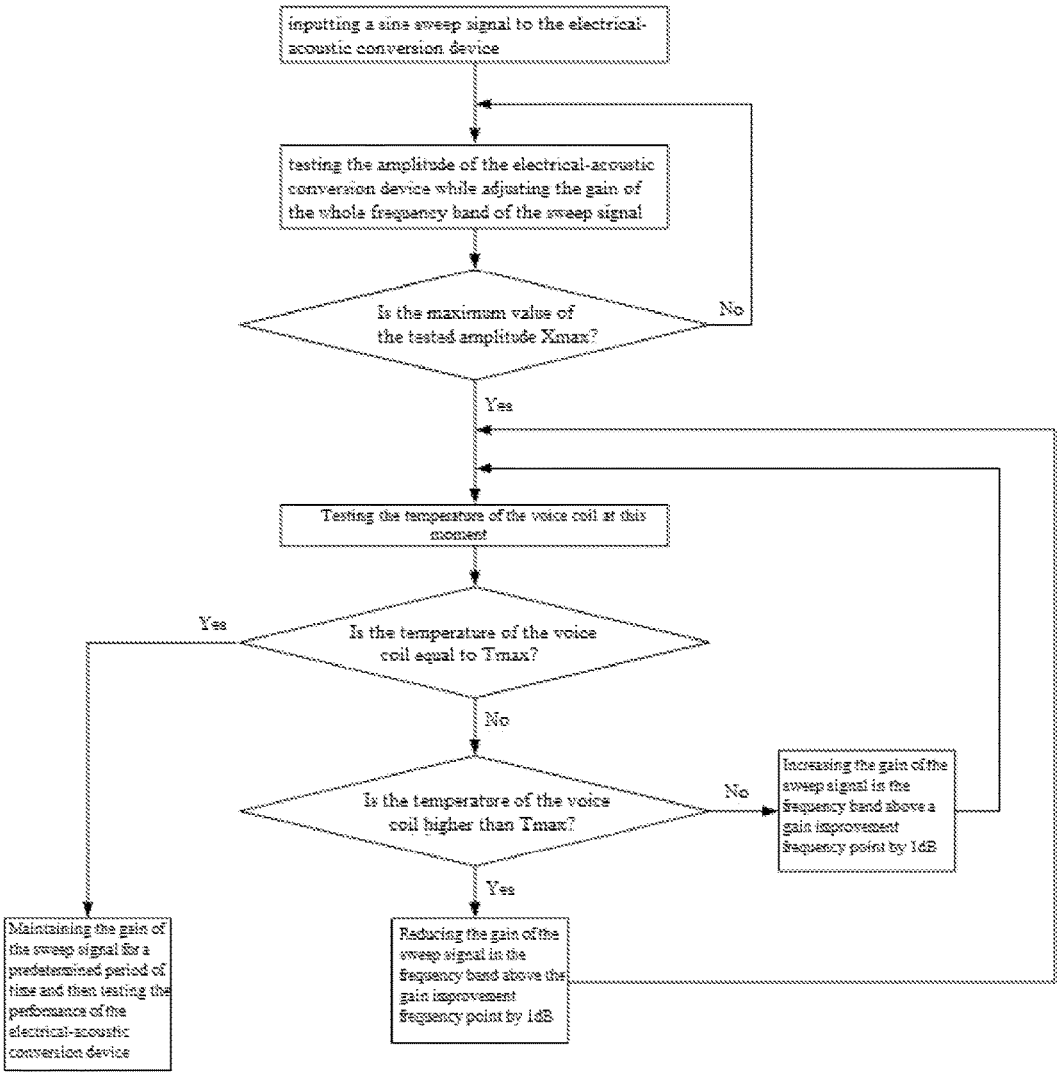
FIG. 5 is a flowchart of a gain adjustment module in FIG. 4 for adjusting the gain of a sweep signal.

Referring to FIG. 5, the process of the gain adjustment module 62 adjusting the gain of the sweep signal is as follows.

(1) Xmax and Tmax to be verified are input to the parameter input module 61 and sent to the gain adjustment module 62.

(2) The gain adjustment module 62 adjusts the gain of the whole frequency band of the sweep signal and the amplitude range finder 3 tests the amplitude of the electrical-acoustic conversion device 5 until the maximum value of the tested maximum value of the amplitude is Xmax, that is, the actually tested amplitude of the electrical-acoustic conversion device 5 at the resonance frequency F0 is Xmax.

(4) The temperature detector 4 tests the temperature of the voice coil at this moment and compares the tested temperature of the voice coil and Tmax.

(5) If the tested temperature of the voice coil is equal to Tmax, step (8) will be performed; otherwise, step (6) will be performed.

(6) If the tested temperature of the voice coil is higher than Tmax, the gain adjustment module 62 reduces the gain of the sweep signal in the frequency band above the gain improvement frequency point by 1 dB, and then returns to step (4); otherwise, step (7) will be performed.

(7) The gain adjustment module 62 increases the gain of the sweep signal in the frequency band above the gain improvement frequency point by 1 dB, and then returns to step (4).

(8) The gain adjustment module 62 maintains the gain of the sweep signal for a predetermined period of time, and then tests the performance of the electrical-acoustic conversion device 5.

In the above embodiment, the gain adjustment module 62 adjusts the gain of the sweep signal in the frequency band above the gain improvement frequency point by 1 dB each time such that the tested temperature of the voice coil approaches Tmax. However, the present invention is not limited to this. Other values such as 0.5 db or 2 dB may be adjusted each time according to the actual application situation. In another embodiment, the value of the gain adjustment module 62 adjusted each time may be different. For example, the gain adjustment module 62 first performs rough adjustment by 1 dB. Once the tested temperature of the voice coil is relatively close to Tmax, then fine adjustment of 0.1 dB will be performed, which can further ensure that the temperature of the voice coil accurately reaches Tmax. All these belong to the protection scope of the present invention.

When performing step (8), the actual maximum amplitude of the electrical-acoustic conversion device 5 is Xmax, the actual temperature of the voice coil is Tmax, the gain of the sweep signal is maintained for a predetermined period of time to test the performance of the electrical-acoustic conversion device 5. If the performance is unqualified, it is determined that the maximum amplitude parameter Xmax and the highest temperature Tmax of the voice coil are irrational.

In the above verification, even if the electrical-acoustic conversion device 5 operates normally at Xmax and Tmax, that is, the performance of the electrical-acoustic conversion device 5 is qualified, Xmax and Tmax still cannot be determined as the maximum values allowed in the actual application of the electrical-acoustic conversion device 5. The maximum value of the actual application of the electrical-acoustic conversion device 5 may be approached gradually. For example, Xmax is increased by 0.01 mm and at the same time Tmax is increased by 0.01 mm, and then the above steps (1) to (8) are performed.

The technical effects of the present invention are as follows.

(1) The simultaneity of the verification of the maximum amplitude Xmax and the verification of the highest temperature of the voice coil is ensured. When the maximum amplitude reaches Xmax, the temperature of the voice coil also reaches Tmax. The extreme vibration state of the electrical-acoustic conversion device is simulated more accurately.

(2) During the conventional verification of the maximum amplitude Xmax, the principle lies in adjusting the gain of the entire sweep signal, which will inevitably cause change in temperature. Thus, the contrast of the test cannot be ensured. The verification of the temperature Tmax is also like this. The present invention adopts a sweep signal the gain of which can be adjusted in segment. The variable of maximum amplitude can be controlled for each kind of gain. The temperature of the voice coil can be detected in real time. The test thus is more accurate and more convincing.

(3) The verification method in the present invention performs temperature verification using the heat generated by the electrical-acoustic conversion device itself, thus the temperature control device is dispensed and the test cost is saved.

Although some specific embodiments of the present invention have been described in detail by way of example, it should be understood by those skilled in the art that the above examples are merely for the sake of description rather than limiting the scope of the present invention. It should be understood by those skilled that the above embodiments may be modified without departing from the scope and spirit of the present invention. The scope of the present invention is limited by the appended claims.

What is claimed is:

1. A method for simultaneously verifying amplitude and temperature parameters of an electrical-acoustic conversion device, comprising steps of:

inputting a sweep signal to the electrical-acoustic conversion device;

testing amplitude of the electrical-acoustic conversion device while adjusting a gain of a whole frequency band of the sweep signal until the maximum value of the tested amplitude is a maximum amplitude parameter Xmax, and testing temperature of a voice coil at this moment; and if the tested temperature of the voice coil at this moment is the highest temperature parameter Tmax of the voice coil, maintaining the gain of the sweep signal for a predetermined period of time and then testing performance of the electrical-acoustic conversion device; if the tested temperature of the voice coil at this moment is higher or lower than Tmax, gradually reducing or increasing the gain of the sweep signal in a frequency band above a gain increasing frequency point until the tested temperature of the voice coil is Tmax, and then maintaining the gain of the sweep signal for a predetermined period of time and then testing the performance of the electrical-acoustic conversion device, wherein the gain improvement frequency point is greater than the resonance frequency FO of the electrical-acoustic conversion device plus 100 Hz, or the gain improvement frequency point is 4 kHz.

2. The method according to claim 1, wherein the sweep signal is a sine sweep signal with a frequency range of 100 Hz-20 kHz.

3. The method according to claim 1, further comprising another step of:

if the tested performance of the electrical-acoustic conversion device is qualified, increasing Xmax by 0.01 mm and at the same time increasing Tmax by 5° C., and then retesting according to the steps of inputting, testing and maintaining.

4. The method according to claim 1, further comprising another step of:

if the tested performance of the electrical-acoustic conversion device is unqualified, determining that the maximum amplitude parameter Xmax and the highest temperature parameter Tmax of the voice coil are irrational.

5. A system for simultaneously verifying amplitude and temperature parameters of an electrical-acoustic conversion device, comprising: a controller, a sweep signal generator, a power amplification unit, an amplitude range finder and a temperature detector;

wherein the controller includes a parameter input module and a gain adjustment module which is connected to the sweep signal generator to control a gain of a sweep signal emitted by the sweep signal generator, and wherein the sweep signal is input to the electrical-acoustic conversion device after being amplified by the power amplification unit;

the amplitude range finder is configured to test amplitude of the electrical-acoustic conversion device and send the tested amplitude to the gain adjustment module, and the temperature detector is configured to test temperature of a voice coil of the electrical-acoustic conversion device and send the tested temperature of the voice coil to the gain adjustment module;

the parameter input module is configured to input a maximum amplitude parameter Xmax and a highest temperature parameter Tmax of the voice coil of the electrical-acoustic conversion device and send the maximum amplitude parameter Xmax and the highest temperature parameter Tmax of the voice coil to the gain adjustment module; and the gain adjustment module is configured for: adjusting a gain of a whole frequency band of the sweep signal until the tested amplitude maximum value is Xmax, and if the tested temperature of the voice coil at this moment is Tmax, maintaining the gain of the sweep signal for a predetermined period of time and then testing performance of the electrical-acoustic conversion device; if the tested temperature of the voice coil at this moment is higher or lower than Tmax, gradually reducing/increasing the gain of the sweep signal in the frequency band above a gain improvement frequency point until the tested temperature of the voice coil is Tmax, and then maintaining the gain of the sweep signal for a predetermined period of time and then testing the performance of the electrical-acoustic conversion device, wherein the gain improvement frequency point is greater than the resonance frequency F0 of the electrical-acoustic conversion device plus 100 Hz, or the gain improvement frequency point is 4 kHz.

6. The system according to claim 5, wherein the sweep signal emitted by the sweep signal generator is a sine sweep signal with a frequency range of 100 Hz-20 kHz.

7. The system according to claim 5, wherein the parameter input module is further configured to: if the tested performance of the electrical-acoustic conversion device is unqualified, increase Xmax by 0.01 mm and at the same time increase Xmax by 5° C., and send the increased maximum amplitude parameter Xmax and the increased highest temperature parameter Tmax of the voice coil to the gain adjustment module.

* * * * *